US005931716A

United States Patent [19]

Hopkins et al.

[11] Patent Number: 5,931,716

[45] Date of Patent: Aug. 3, 1999

[54] ILLUMINATED FLYING TOY

[76] Inventors: Lloyd M. Hopkins, 414 Burke St.; Jane M. Hopkins, 414 Burke St., both of Jersey Shore, Pa. 17740

[21] Appl. No.: 08/871,712

[22] Filed: Jun. 9, 1997

[51] Int. Cl.[6] ..... A63H 27/00; A63H 5/00

[52] U.S. Cl. ..... 446/230; 446/47; 446/397; 446/485

[58] Field of Search ..... 446/47, 242, 268, 446/397, 485, 230–231

[56] References Cited

U.S. PATENT DOCUMENTS

| | | | |
|---|---|---|---|
| D. 293,698 | 1/1988 | Nose | D21/86 |
| D. 345,586 | 3/1994 | Hanna | D21/86 |
| 3,394,491 | 7/1968 | Valentine | 446/397 |
| 3,518,788 | 7/1970 | Sides | 446/219 |
| 3,786,246 | 1/1974 | Johnson et al. | 446/47 |
| 4,294,035 | 10/1981 | Klein | 446/397 |
| 4,301,616 | 11/1981 | Gudgel | 46/228 |
| 4,320,593 | 3/1982 | Sarkis | 46/74 D |
| 4,467,554 | 8/1984 | Russell | 446/242 |
| 4,817,163 | 3/1989 | Stastny | 381/150 |
| 5,032,098 | 7/1991 | Balogh et al. | 446/47 |
| 5,041,947 | 8/1991 | Yuen et al. | 362/35 |
| 5,108,340 | 4/1992 | Farrow | 446/242 |
| 5,290,184 | 3/1994 | Balogh et al. | 446/47 |
| 5,319,531 | 6/1994 | Kutnyak | 362/184 |

FOREIGN PATENT DOCUMENTS

| | | | |
|---|---|---|---|
| 2251810 | 7/1992 | United Kingdom | 446/242 |

*Primary Examiner*—Robert A. Hafer
*Assistant Examiner*—Laura Fossum
*Attorney, Agent, or Firm*—David L. Volk

[57] ABSTRACT

A substantially disk shaped body includes a downwardly curved perimeter and a circular, raised central portion. A plurality of substantially evenly spaced apertures are distributed annularly about the central portion. A switch is positioned substantially at a top of the central portion, the switch including a hole there-through for connecting to a cord for hanging the body. A circuit includes the switch, a battery receptacle, a sound generating device, and at least one light source. The circuit is configured to activate the light source when the switch is moved to one side, and to activate the light source and the sound generating device when the switch is moved to an opposite side. The battery receptacle, the sound generating device, and the light source are positioned beneath the central portion. A circular plate is configured to fit within an annular channel on an underside of the body in a centered fashion beneath the central portion, and beneath the battery receptacle, the sound generating device and the light source. The plate includes a substantially clear perimeter portion and a substantially opaque center portion. The light source is positioned such that when the light source is on, light is transmitted through the perimeter portion of the plate and through the apertures.

1 Claim, 2 Drawing Sheets

ILLUMINATED FLYING TOY

BACKGROUND OF THE INVENTION

1. Field of the Invention

The present invention relates to toys, specifically to illuminated, flying disk shaped toys.

2. Description of the Related Art

Flying disk shaped toys are played with by millions of people across the country. To date, no flying toy has been invented with the uniquely positioned lights, circuitry and controls, and the unique appearance of the present invention.

SUMMARY OF THE INVENTION

The illuminated flying toy of the present invention includes a substantially disk shaped body having a downwardly curved perimeter and a circular, raised central portion. A plurality of substantially evenly spaced apertures are distributed annularly about the central portion. A switch is positioned substantially at a top of the central portion, the switch including a hole therethrough for connecting to a cord for hanging the toy. A circuit includes the switch, a battery receptacle, a sound generating device, and at least one light source. The circuit is configured to activate the light source when the switch is moved to one side, and to activate the light source and the sound generating device when the switch is moved to an opposite side. The battery receptacle, the sound generating device, and the light source are positioned beneath the central portion. A circular plate is configured to fit within an annular channel on an underside of the body in a centered fashion beneath the central portion, and beneath the battery receptacle, the sound generating device and the light source. The plate includes a substantially clear perimeter portion and a substantially opaque center portion. The light source is positioned such that when the light source is on, light is transmitted through the perimeter portion of the plate and through the apertures.

Because of the unique positioning of the light source, the plate and the apertures, light is transmitted through the plate and the apertures in an attractive manner which enhances the UFO effect of the flying toy.

Because the plate is transparent at its perimeter and opaque at its center, it conceals the electrical components from view, yet permits light to transmit downwardly through the plate in a dramatic, ring-like pattern.

Because the plate is positioned below the electrical components, the aerodynamic structure and flying capability of the toy is not disrupted or diminished by the electrical components.

Because the switch includes a means for hanging the toy, the toy may be displayed by hanging from a ceiling or other structure.

Still further features and advantages will become apparent from the ensuing description and drawings.

DETAILED DESCRIPTION

Figure 1:
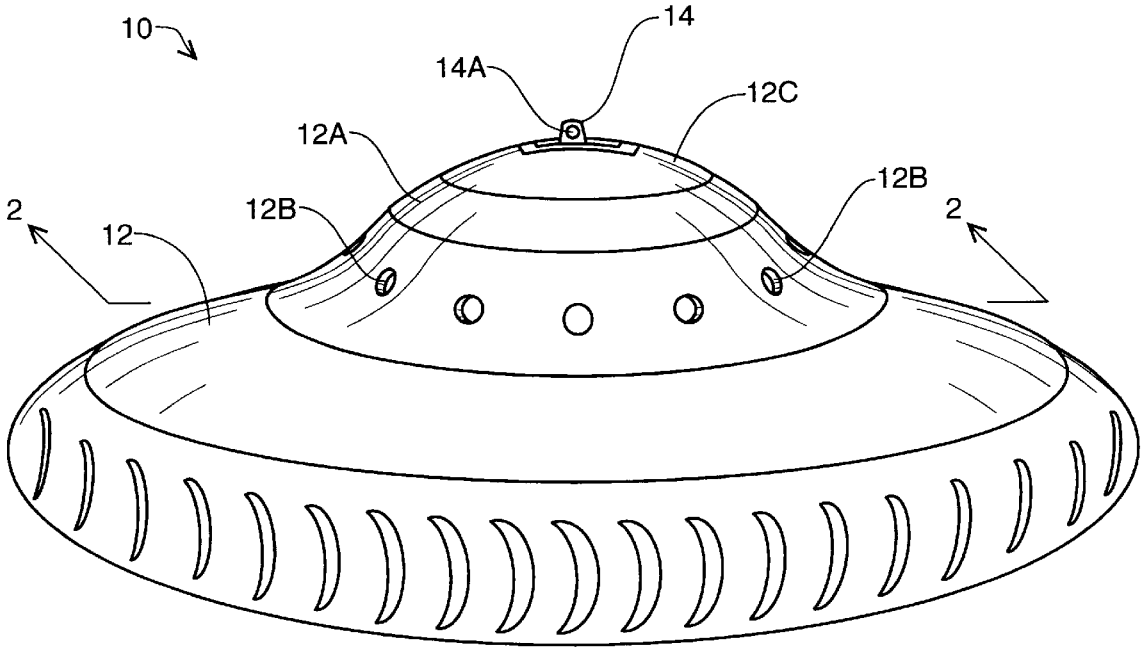
FIG. 1 is a top perspective view of an illuminated flying toy of the present invention.

FIG. 1 is a top perspective view of an illuminated flying toy 10 of the present invention. The toy 10 includes a substantially disk shaped body 12 having a downwardly curved perimeter and a circular, raised central portion 12A. A plurality of substantially evenly spaced apertures 12B are distributed annularly about the central portion 12A. A switch 14 is positioned substantially at a top 12C of the central portion 12A, the switch 14 including a hole 14A therethrough for connecting to a cord (not shown) for hanging the toy 10 from a ceiling (not shown) or other structure. The crescent shaped pattern as shown is an optional surface ornamentation.

Figure 2:
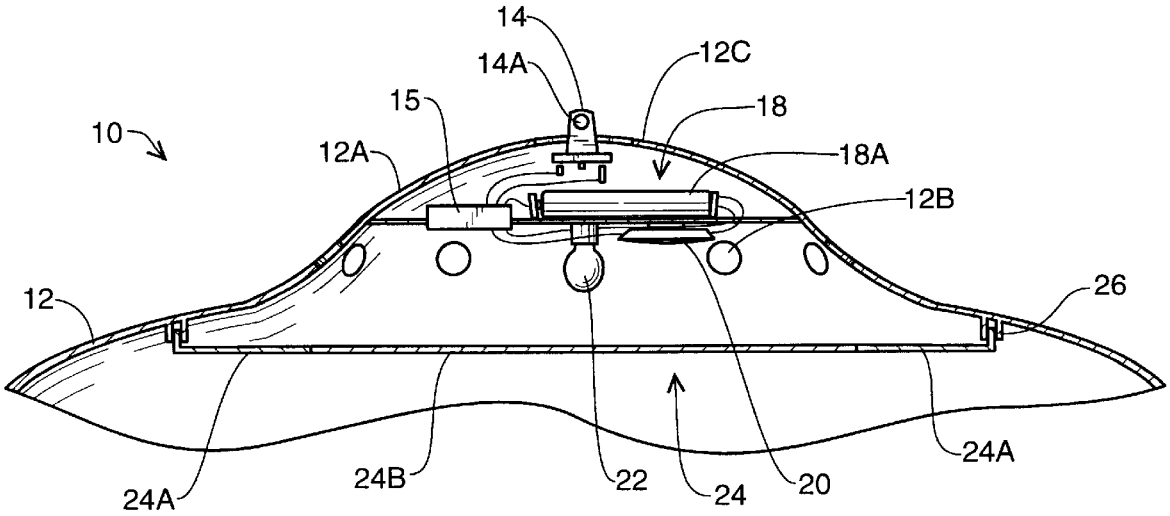
FIG. 2 is a cross-sectional view of the toy, taken along line 2—2 of FIG. 1.
Figure 3:
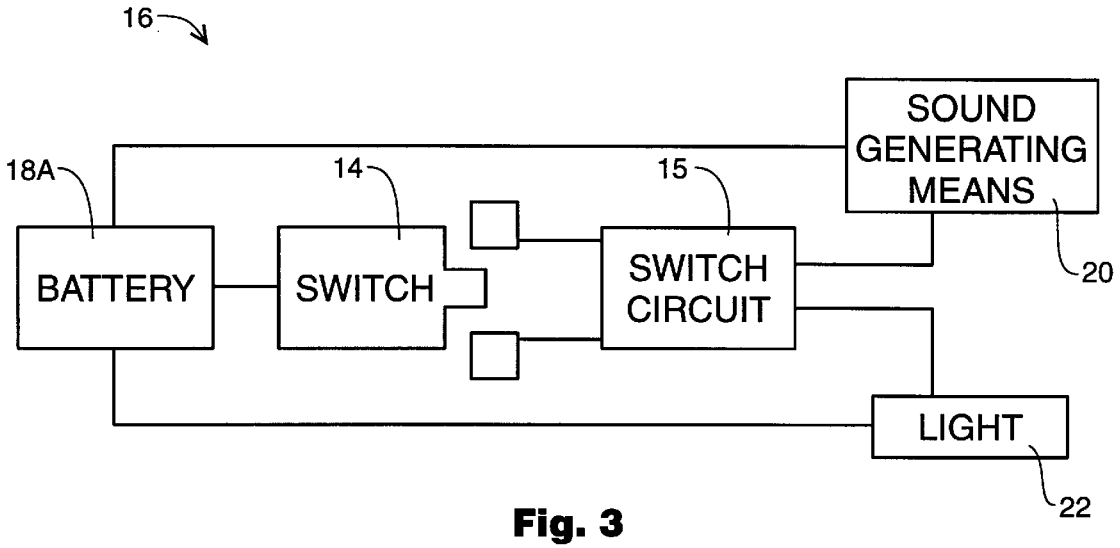
FIG. 3 is a circuit diagram for the toy's circuit.

FIG. 2 is a cross-sectional view of the toy 10, taken along line 2—2 of FIG. 1. FIG. 3 is a block schematic diagram of a circuit means 16 which produces light and sound for enhanced play value and enjoyment. Referring to both figures, the circuit means 16 includes the switch 14, a switch circuit 15, a battery receptacle 18 adapted to hold a battery 18A therein, a sound generating means 20, and at least one light source 22.

The circuit means 16 is configured in a known manner to activate the light source 22 through the switch circuit 15, when the switch 14 is moved to one side, and to activate the light source 22 and the sound generating means 20 through the switch circuit 15, when the switch 14 is moved to an opposite side. The battery receptacle 18, the sound generating means 20, the switch circuit 15 and the light source 22 are positioned beneath the central portion 12A.

Figure 4:
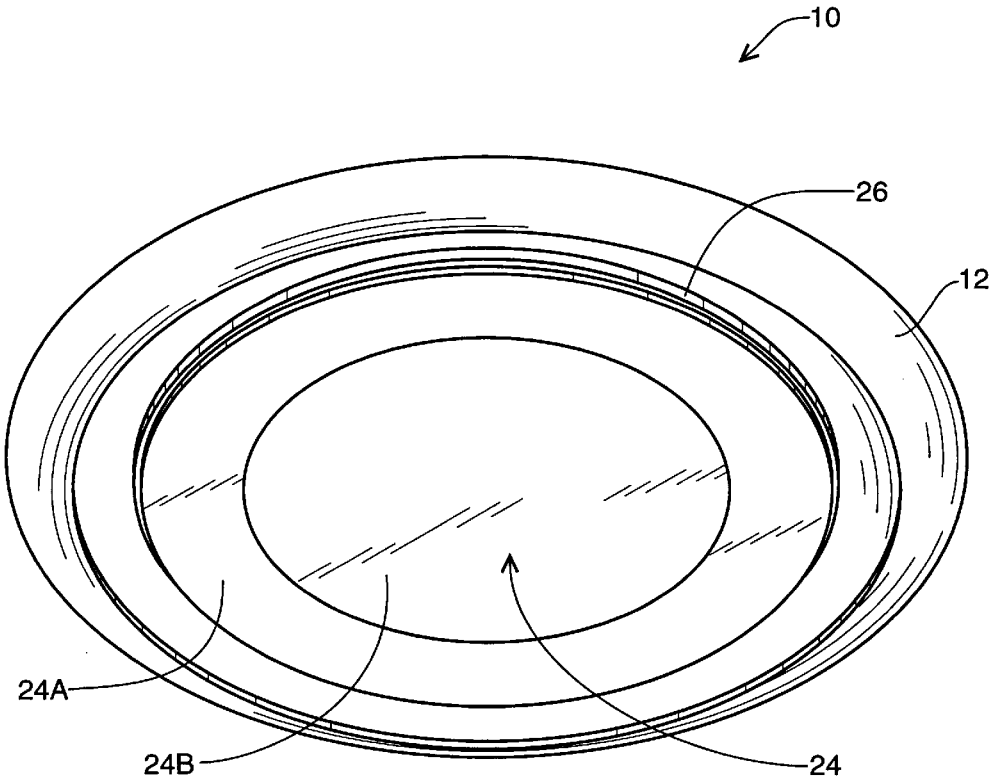
FIG. 4 is a bottom perspective view of the toy.

FIG. 4 is a bottom perspective view of the toy 10. Referring to FIGS. 1 and 3, a circular plate 24 is configured to fit within an annular channel 26 on an underside of the body 12 in a centered fashion beneath the central portion 12A, and beneath the battery receptacle 18, the switch circuit 15, the sound generating means 20 and the light source 22. The plate 24 includes a substantially clear perimeter portion 24A and a substantially opaque center portion 24B. The light source 22 is positioned such that when the light source 22 is on, light is transmitted through the perimeter portion 24A of the plate 24 and through the apertures 12B.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A flying toy comprising:

a. a substantially disk shaped body having a downwardly curved perimeter and a circular, raised central portion;

b. a plurality of substantially evenly spaced apertures distributed annularly about the central portion;

c. a switch positioned substantially at a top of the central portion, the switch including a connection means for connecting to a cord for hanging the toy;

d. a circuit means including the switch, a battery receiving means, a sound generating means, and at least one light source;

e. the circuit means configured to activate the light source when the switch is moved to a first position, and to activate the light source and the sound generating means when the switch is moved to a second position;

f. the battery receiving means, the sound generating means, and the light source positioned beneath the central portion;

g. a circular plate configured to attach to an underside of the body in a centered fashion beneath the central portion, and beneath the battery receiving means, the sound generating means and the light source;

h. the plate having a substantially clear perimeter portion and a substantially opaque center portion; and i. the light source positioned such that when the light source is on, light is transmitted through the perimeter portion of the plate and through the apertures.

* * * * *